US012595608B2

(12) United States Patent
Kang et al.

(10) Patent No.: US 12,595,608 B2
(45) Date of Patent: Apr. 7, 2026

(54) WASHING MACHINE

(71) Applicant: SAMSUNG ELECTRONICS CO., LTD., Suwon-si (KR)

(72) Inventors: Heejin Kang, Suwon-si (KR); Younghyun Kim, Suwon-si (KR); Junho Kim, Suwon-si (KR); Seulgi Lee, Suwon-si (KR); Hyounyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 121 days.

(21) Appl. No.: 18/428,215

(22) Filed: Jan. 31, 2024

(65) Prior Publication Data

US 2024/0167208 A1 May 23, 2024

Related U.S. Application Data

(63) Continuation of application No. PCT/KR2022/012578, filed on Aug. 23, 2022.

(30) Foreign Application Priority Data

Oct. 22, 2021 (KR) ..... 10-2021-0141983

(51) Int. Cl.
*D06F 25/00* (2006.01)
*D06F 37/04* (2006.01)
(Continued)

(52) U.S. Cl.
CPC ..... *D06F 25/00* (2013.01); *D06F 37/04* (2013.01); *D06F 37/26* (2013.01); *D06F 37/304* (2013.01); *D06F 58/08* (2013.01); *D06F 58/20* (2013.01)

(58) Field of Classification Search
CPC ..... D06F 25/00; D06F 37/02–08
See application file for complete search history.

(56) References Cited

U.S. PATENT DOCUMENTS 5,762,979 A 6/1998 Van de Velde Keyser
6,411,473 B1 6/2002 Ozue et al.
(Continued)

FOREIGN PATENT DOCUMENTS

CN 104704157 A 6/2015
JP 11-147147 A 6/1999
(Continued)

OTHER PUBLICATIONS

JP4603064B2 Machine Translation (Year: 2010).*
(Continued)

*Primary Examiner* — Spencer E. Bell
(74) *Attorney, Agent, or Firm* — STAAS & HALSEY LLP

(57) ABSTRACT

A washing machine with a drying function can include a tub, a drum inside the tub and including: a cylindrical body having a rear end opening, and a drum back coupled to the cylindrical body to be over the rear end opening and including: a plurality of recess portions, a plurality of openings between adjacent recess portions and a plurality of porous plates coupled to the plurality of openings, a motor to provide a rotational force to the drum, a flange shaft between the drum and the motor to transmit the rotational force of the motor to the drum and including: a hub, and a plurality of flange portions extending radially from the hub, a drying duct configured to supply heated air into the tub, and an exhaust duct configured to return the heated air from the tub through the plurality of porous plates to the drying duct.

14 Claims, 11 Drawing Sheets

(51) Int. Cl.

| | |
|---|---|
| ***D06F 37/26*** | (2006.01) |
| ***D06F 37/30*** | (2020.01) |
| ***D06F 58/08*** | (2006.01) |
| ***D06F 58/20*** | (2006.01) |

(56) References Cited

U.S. PATENT DOCUMENTS

| | | | | |
|---|---|---|---|---|
| 6,762,903 | B2 | 7/2004 | Kano et al. | |
| 7,302,815 | B2 | 12/2007 | Kim et al. | |
| 7,506,425 | B2 | 3/2009 | Kim | |
| 7,748,139 | B2 | 7/2010 | Hong et al. | |
| 7,836,607 | B2 | 11/2010 | Kim | |
| 8,026,629 | B2 | 9/2011 | Schmidt et al. | |
| 8,112,904 | B2 | 2/2012 | Kono et al. | |
| 8,549,729 | B2 | 10/2013 | Lee et al. | |
| 9,062,405 | B2 | 6/2015 | Yoon et al. | |
| 10,533,274 | B2 | 1/2020 | Prushinskiy et al. | |
| 10,590,583 | B2 | 3/2020 | Kitayama | |
| 10,714,641 | B2 | 7/2020 | Lacrampe | |
| 11,028,515 | B2 | 6/2021 | Lee et al. | |
| 2005/0229649 | A1 | 10/2005 | Kim et al. | |
| 2005/0252252 | A1 | 11/2005 | Lee et al. | |
| 2006/0090521 | A1 | 5/2006 | Kim et al. | |
| 2006/0254321 | A1 | 11/2006 | Lim et al. | |
| 2010/0024239 | A1* | 2/2010 | Kono | D06F 58/24 34/76 |
| 2011/0041565 | A1 | 2/2011 | Kim et al. | |
| 2011/0126596 | A1* | 6/2011 | Kim | D06F 37/04 29/525.11 |
| 2015/0225885 | A1 | 8/2015 | Kim et al. | |
| 2017/0298551 | A1 | 10/2017 | Lv et al. | |
| 2019/0257020 | A1* | 8/2019 | Ikeda | D06F 23/02 |
| 2020/0384206 | A1 | 12/2020 | Wieselblad | |
| 2021/0077090 | A1 | 3/2021 | Rosner et al. | |

FOREIGN PATENT DOCUMENTS

| | | | |
|---|---|---|---|
| JP | 2005-177513 | A | 7/2005 |
| JP | 4603064 | B2 | 12/2010 |
| JP | 4679352 | B2 | 4/2011 |
| JP | 5922829 | B2 | 5/2016 |
| JP | 2019-193707 | A | 11/2019 |
| KR | 10-1998-0047548 | A | 9/1998 |
| KR | 10-0158976 | B1 | 1/1999 |
| KR | 10-0176507 | B1 | 5/1999 |
| KR | 20-0180944 | Y1 | 5/2000 |
| KR | 20-0272315 | Y1 | 4/2002 |
| KR | 20-0284284 | Y1 | 8/2002 |
| KR | 10-0381814 | | 6/2003 |
| KR | 10-0428201 | B1 | 5/2004 |
| KR | 10-0441098 | B1 | 7/2004 |
| KR | 20-0358900 | Y1 | 8/2004 |
| KR | 10-2005-0101659 | A | 10/2005 |
| KR | 10-2005-0101740 | A | 10/2005 |
| KR | 10-2005-0115726 | A | 12/2005 |
| KR | 10-2006-0012493 | A | 2/2006 |
| KR | 10-0587298 | B1 | 6/2006 |
| KR | 10-0598000 | B1 | 7/2006 |
| KR | 10-0613802 | B1 | 8/2006 |
| KR | 10-2006-0117528 | A | 11/2006 |
| KR | 10-2006-0121078 | A | 11/2006 |
| KR | 10-0657465 | B1 | 12/2006 |
| KR | 10-0669180 | | 1/2007 |
| KR | 10-0680203 | B1 | 2/2007 |
| KR | 10-0855658 | B1 | 9/2008 |
| KR | 10-2009-0012766 | A | 2/2009 |
| KR | 10-2010-0129156 | A | 12/2010 |
| KR | 10-1056070 | B1 | 8/2011 |
| KR | 10-2012-0040379 | A | 4/2012 |
| KR | 10-2012-0045612 | A | 5/2012 |
| KR | 10-1210220 | B1 | 12/2012 |
| KR | 10-1315137 | B1 | 10/2013 |
| KR | 10-2014-0019553 | A | 2/2014 |
| KR | 20-0474446 | Y1 | 9/2014 |
| KR | 10-1528062 | B1 | 6/2015 |
| KR | 10-2016-0092814 | A | 8/2016 |
| KR | 10-2016-0131008 | A | 11/2016 |
| KR | 10-1680437 | B1 | 11/2016 |
| KR | 10-2018-0037882 | A | 4/2018 |
| KR | 10-2018-0039395 | A | 4/2018 |
| KR | 10-2018-0058729 | A | 6/2018 |
| KR | 10-1870065 | | 6/2018 |
| KR | 10-2018-0101824 | A | 9/2018 |
| KR | 10-1937047 | B1 | 1/2019 |

OTHER PUBLICATIONS

KR20050101740A Machine Translation (Year: 2005).*
Extended European Search Report dated Sep. 16, 2024 for European Application No. 22883749.8.
International Search Report dated Dec. 19, 2022 in International PatentApplication No. PCT/KR2022/012578.
PCT/ISA/237 dated Dec. 19, 2022 in International Patent Application No. PCT/KR2022/012578.

* cited by examiner

WASHING MACHINE

CROSS-REFERENCE TO RELATED APPLICATIONS

This is a continuation application of International Application No. PCT/KR2022/012578, filed Aug. 23, 2022, which is incorporated herein by reference in its entirety, it being further noted that foreign priority benefit is based upon Korean Patent Application No. 10-2021-0141983, filed Oct. 22, 2021, which is incorporated by reference herein in its entirety.

TECHNICAL FIELD

The disclosure relates to a washing machine, and more particularly to a washing machine having an improved structure for improved drying efficiency.

BACKGROUND ART

A washing machine is an appliance for washing clothes with electric power, generally comprising a cabinet forming the exterior of the washing machine, a tub for storing washing water inside the cabinet, a drum rotatably installed inside the tub, and a motor for rotationally driving the drum.

As the drum is rotated by the motor while laundry and washing water are loaded into the drum, the laundry rubs against with the drum and the washing water to remove dirt from the laundry.

A drum type washing machine having a drying function is typically equipped with a drying device which dries laundry by blowing heat from a heater into a receiving space in which the laundry is received, and may perform the drying function independently, or, in conjunction with a washing function, perform the drying function after completion of dewatering function.

A drying device of a washing machine heats laundry by supplying hot air heated by a heating device to the drum, evaporates the moisture in the laundry, and dries the laundry by condensing and discharging the evaporated moisture.

To this end, a number of holes are formed on a rear surface of the drum, and the holes serve to pass wet vapor that enters the inside of the tub.

However, the holes on the rear surface of the drum only partially overlap holes on a rear surface of the tub, which hinders fluid flow.

In addition, the holes on the rear surface of the tub are connected to ducts or hoses to draw in or discharge wet vapor, which are sometimes blocked by a flange shaft when the drum is rotated, resulting in a fluid flow obstruction.

DISCLOSURE

Technical Problem

The present disclosure is directed to providing a washing machine with an improved structure for improved drying efficiency.

Further, the present disclosure is directed to providing a washing machine with a structure capable of improving the fluid flow.

Technical Solution

An aspect of the present disclosure can include a washing machine with a drying function including: a tub to store washing water, a drum inside the tub and including: a cylindrical body having a front end opening and a rear end opening, and a drum back coupled to the cylindrical body so as to be over the rear end opening of the cylindrical body and including: a plurality of recess portions recessed from a rear of the drum back toward a front of the drum a plurality of openings formed between each adjacent recess portions of the plurality of recess portions, and a plurality of porous plates respectively corresponding, and respectively coupled, to the plurality of openings, a motor to provide a rotational force to the drum, a flange shaft between the drum and the motor to transmit the rotational force of the motor to the drum and including: a hub at a center of the drum back, and a plurality of flange portions extending radially from the hub and respectively corresponding to the plurality of recess portions, a drying duct configured to supply heated air into the tub, and an exhaust duct configured to return the heated air from the tub through the plurality of porous plates to the drying duct.

Each recess portion of the plurality of recess portions can be formed of a metal material, and each porous plate of the plurality of porous plates can be formed of a resin material.

Each porous plate of the plurality of porous plates can be coupled to the corresponding opening of the plurality of openings by a seaming method.

Each porous plate of the plurality of porous plates can be coupled to the corresponding opening of the plurality of openings by an insert injection method.

The tub can include a plurality of exhaust ports, and the exhaust duct can include a plurality of exhaust connection portions respectively corresponding to, and respectively connecting, the plurality of exhaust ports to the exhaust duct.

When the drum is rotated by the rotational force to a position so that one flange portion of the plurality of flange portions overlaps one or more exhaust ports of the plurality of exhaust ports, at least one different exhaust port of the plurality of exhaust ports can be not overlapped by any flange portion of the plurality of flange portions.

Each exhaust port of the plurality of exhaust ports can be a distance from a center of a rear surface of the tub, the distance of each exhaust port of the plurality of exhaust ports from the center can be different from the distance of each other exhaust port of the plurality of exhaust ports from the center.

A width of at least one exhaust port of the plurality of exhaust ports can be different from a width of another exhaust port of the plurality of exhaust ports.

Another aspect of the present disclosure can include a washing machine with a drying function comprising: a tub including a tub back having a plurality of exhaust ports through the tub back; a cylindrical drum, inside the tub, having a front end opening and a rear end opening and including: a drum back spaced apart from the tub back, coupled to the cylindrical drum so as to be over the rear end opening, and including: a plurality of first regions that each include a plurality of holes through the drum back, and a plurality of second regions extending radially and separating adjacent first regions of the plurality of first regions in a circumferential direction of the drum back; a drying duct to supply heated air into the tub; a motor to provide a rotational force to the cylindrical drum, wherein the plurality of exhaust ports are configured so that, when the cylindrical drum is rotated by the rotational force to a position at which a second region of the plurality of second regions overlaps an exhaust port of the plurality of exhaust ports, another exhaust port of the plurality of exhaust ports is overlapped by at least one first region of the plurality of first regions and is not obstructed by any second region; and an exhaust duct connected to the plurality of exhaust ports to return the heated air from the tub, through the at least one first region of the plurality of first regions and the another exhaust port.

Another aspect of the present disclosure can include a washing machine including: a cabinet, a tub disposed inside the cabinet and configured to store washing water, a drum rotatably disposed inside the tub, a motor configured to provide a rotational force to the drum, and a flange shaft arranged between the drum and the motor to transmit the rotational force of the motor to the drum, wherein the drum includes a cylindrical body having open front and rear, and a drum back coupled to the open rear of the cylindrical body, and wherein the flange shaft includes a hub portion disposed at a center of the drum back, and a plurality of flange portions extending radially from the hub, and wherein the drum back includes a plurality of recess portions respectively corresponding to the plurality of flange portions and recessed from a rear side to a front side, a plurality of openings formed between the recess portions adjacent to each other, and a plurality of porous plates respectively coupled to the plurality of openings.

Each of the plurality of recess portions may be formed of a metal material, and the porous plates may be formed of a resin material.

A plurality of exhaust ports may be provided in the rear surface of the tub, and as the drum rotates, when one of the plurality of flange portions is in a position overlapping with one of the plurality of exhaust ports, at least a different one of the plurality of exhaust ports may be in a position not overlapping with any one of the plurality of flange portions.

The plurality of exhaust ports may be each arranged at different distances from a center of the rear surface of the tub.

At least one of the plurality of exhaust ports has a width different from that of another exhaust port.

Advantageous Effects

According to various embodiments of the present disclosure, the structure of the drum of the washing machine is improved to promote fluid flow, thereby improving the drying efficiency.

Further, according to various embodiments of the present disclosure, fluid flow obstruction caused by the blockage of holes by the rotation of the drum and fluid flow obstruction caused by foreign substances may be improved.

DETAILED DESCRIPTION OF THE MODES OF THE EMBODIMENTS

Figure 1:
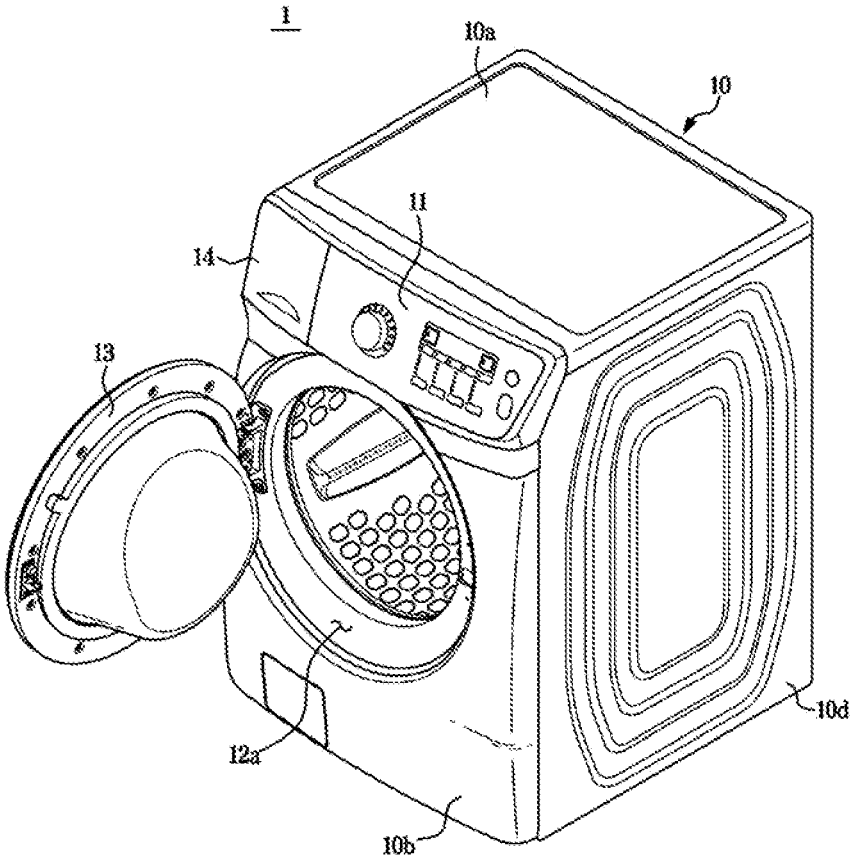
FIG. 1 is a perspective view showing a washing machine according to an embodiment of the present disclosure.

Embodiments described in the disclosure and configurations shown in the drawings are merely examples of the embodiments of the disclosure and may be modified in various different ways at the time of filing of the present application to replace the embodiments and drawings of the disclosure.

In addition, the same reference numerals or signs shown in the drawings of the disclosure indicate elements or components performing substantially the same function. The singular form of a noun corresponding to an item may include one or a plurality of the items unless clearly indicated otherwise in a related context.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms first, second, primary, secondary, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Further, as used in the disclosure, the terms "front", "rear", "top", "bottom", "side", "left", "right", "upper", "lower", and the like are defined with reference to the drawings, and are not intended to limit the shape and position of each component.

Figure 2:
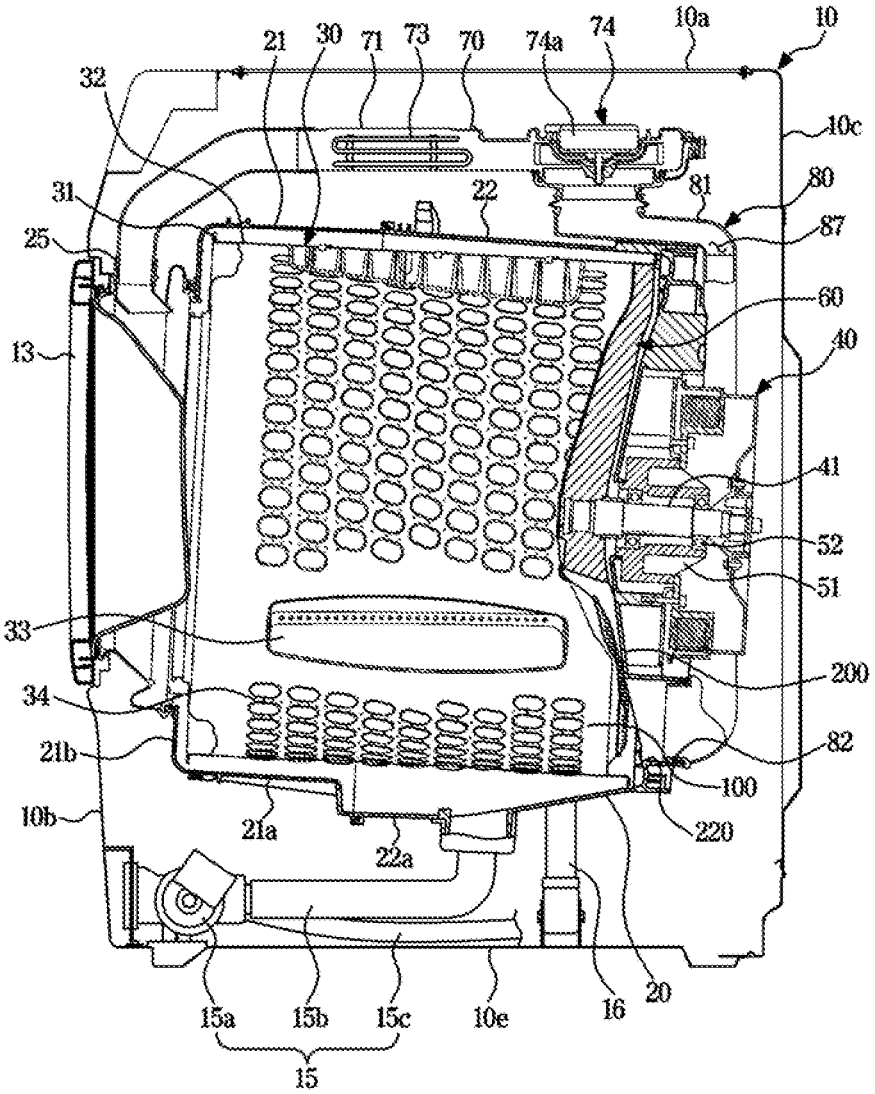
FIG. 2 is a cross-sectional view showing the washing machine according to an embodiment of the present disclosure.
Figure 3:
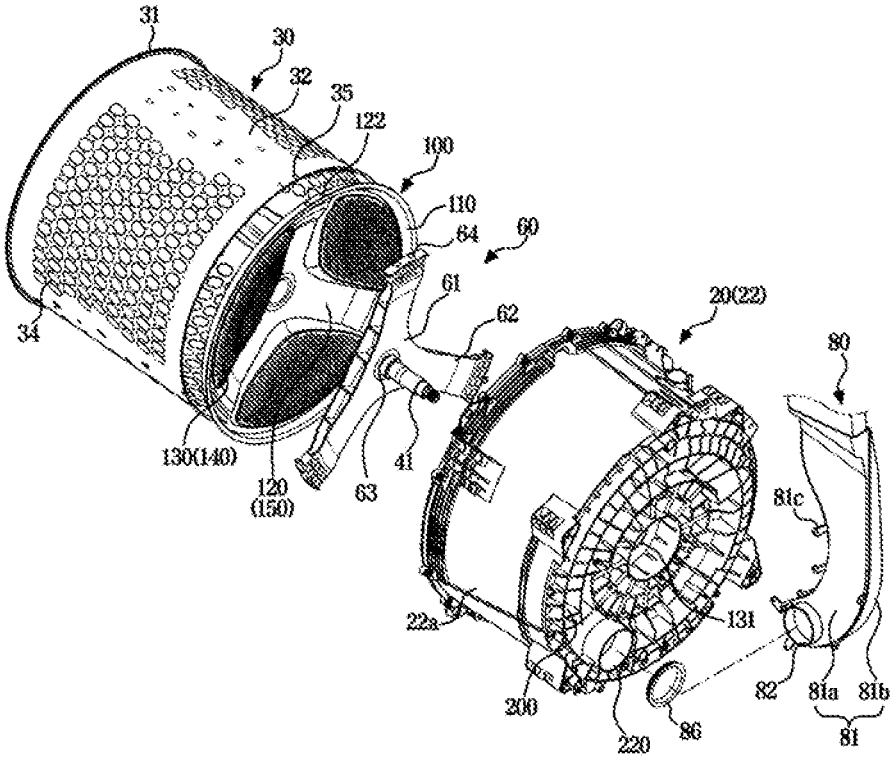
FIG. 3 is an exploded perspective view showing a state in which a drying duct is coupled to a tub of the washing machine according to an embodiment of the present disclosure.

FIG. 1 is a perspective view illustrating a washing machine according to an embodiment, FIG. 2 is a cross-sectional view illustrating the washing machine according to an embodiment, and FIG. 3 is an exploded perspective view illustrating a state in which a drying duct is coupled to a tub of the washing machine according to an embodiment.

As shown in FIGS. 1 to 3, a washing machine 1 may include a cabinet 10 forming an exterior thereof, a tub 20 receiving washing water or rinse water to be used in a washing cycle or a rinsing cycle, a drum 30 receiving laundry, and a motor 40 rotating the drum 30.

The cabinet 10 may be provided in a substantially hexahedral shape. The cabinet 10 may include frames 10*a*, 10*b*, 10*c*, 10*d*, and 10*e*. The frames 10*a*, 10*b*, 10*c*, 10*d*, and 10*e* may include a top frame 10*a* forming an upper surface of the cabinet 10, front frame 10*b* and rear frame 10*c* forming front and rear surfaces of the cabinet 10, a side frame 10*d* connecting the front frame 10*b* and rear frame 10*c* and forming side and bottom surfaces of the cabinet 10, and a bottom frame 10*e*.

An inlet 12*a* may be formed in the front frame 10*b* of the cabinet 10 to place laundry into or out of the drum 20. The inlet 12*a* may be opened and closed by a door 13 installed in the front frame 10*b* of the cabinet 10.

A control panel 11 may be provided on an upper portion of the front frame 10*b* of the cabinet 10 to control an operation of the washing machine 1. The control panel 11 may be provided with an input device in the form of a rotary dial for inputting the operation of the washing machine 1, and may be provided with a display device for displaying various information about the washing machine 1, but is not limited thereto. The control panel may include various types of input devices and display devices.

A drum 30 having a cylindrical shape may be provided inside the cabinet 10. The drum 30 may be rotatable by receiving power from a drive device. The drive device rotating the drum 20 will be described later.

The tub 20 may include a first tub 21 positioned at an inner front of the cabinet 10, and a second tub 22 coupled to a rear side of the first tub 21. The first tub 21 may include a cylindrical portion 21*a* arranged circumferentially, and a front surface 21*b* positioned in front of the cylindrical portion 21*a*. A connection portion 25 for connecting a drying duct 70, which will be described later, may be provided near the front surface 21*b* of the first tub 20.

The second tub 22 may include a cylindrical portion 22*a* disposed in a circumferential direction. The second tub 22 may have a tub back 200 formed on a rear surface of the second tub 20. In an embodiment of the disclosure, it is shown as an example that the tub back of the second tub is formed integrally with the cylindrical portion, but the disclosure is not limited thereto. The tub back may form a rear surface of the tub. The tub 20 may be provided by connecting the cylindrical portion 21*a* of the first tub 21 and the cylindrical portion 22*a* of the second tub 22.

The tub back 200 may have a through-hole 131 formed in the center through which a shaft passes. The tub back 200 may have an exhaust port 220 formed on one lower side to which an exhaust duct 80 is connected. The exhaust port 220 of the tub back 200 will be described later.

On an upper portion of the tub 20, a water supply device (not shown) for supplying washing water to the tub 20, and a detergent supply device 14*a* connected to the water supply device so that the washing water delivered through the water supply device is supplied to the tub 20 together with detergent may be arranged.

At a lower portion of the tub 20, a drainage device 15 is arranged to discharge the washing water used for washing to the outside of the cabinet 10. The drainage device 15 may include a drainage pump 15*a* for draining the water in the tub 20 to the outside of the cabinet 10, a connection hose 15*b* connecting the tub 20 and the drainage pump 20 so that the water in the tub 20 may flow into the drainage pump 15*a*, and a drainage hose 15*c* guiding the water pumped by the drainage pump 15*a* to the outside of the cabinet 10.

The tub 20 may be supported by a damper 16. The damper 16 may connect the bottom frame 10*e* of the cabinet 10 and an outer surface of the tub 20. In addition, the damper 16 may be placed on the upper, left, and right sides of the cabinet 10, in addition to the bottom frame, to support the tub 20.

The drum 30 may include a drum body 32, a drum front 31, and a drum back 100.

The drum body 32 may be formed in a hollow cylindrical shape with open front and rear ends. A plurality of through-holes 34 for a flow of washing water may be formed in the cylindrical drum body 32. A plurality of lifters 33 may be mounted on an inner circumferential surface of the drum body 32 to allow laundry to rise and fall when the drum 30 rotates.

The drum 30 may include the drum front 31 and the drum back 100. The drum front 31 may be placed at a front end of the drum body 32, and the drum back 100 may be placed at a rear end of the drum body 32.

A coupling hole 35 may be provided on a side surface of the drum body 32. The coupling hole 35 may be provided at the rear end of the drum body 32 so that the drum back 100 may be coupled thereto. The coupling hole 35 may be provided in a plurality. The coupling holes 35 may be provided to secure a flange shaft 60 installed in the drum back 100. The coupling holes 35 may be formed to correspond to the flange shaft 60. The coupling holes 35 may be formed to be spaced apart at regular intervals along the circumferential direction of the drum body 32 to correspond to the flange shaft 60.

The drum front 31 may be provided to correspond to a front end opening of the drum body 32. The drum back 100 may be provided to correspond to a rear end opening of the drum body 32.

The drum back 100 may be formed in a disk shape to block the rear end opening of the drum body 32. The drum back 100 will be described later.

The drum 30 may rotate within the tub 20 by a rotational force transmitted by a shaft 41. The shaft 41 for transmitting power of the motor 40 may be connected to the drum back 100 of the drum 30. The motor 40 may be provided outside the tub 20. The motor 40 may be connected to the drum 30 through the shaft 41. The shaft 41 may penetrate the tub back 200 of the tub 20 to be rotatably supported by a bearing 52 and a bearing housing 51.

The motor 40 may include a stator fixed to an outside of the tub back 200, and a rotor rotatably arranged to connect with the shaft 41. The rotor may electromagnetically interact with the stator to convert a rotational electrical force into a mechanical rotational force. The rotation of the rotor may be transmitted to the drum 30 via the shaft 41.

The drum back 100 may be connected to the shaft 41 via the flange shaft 60. The flange shaft 60 may be provided to transmit power of the motor 40.

The flange shaft 60 may include a hub portion 61 disposed at the center of the drum back 100, and a plurality of flange portions 62 extending radially from the hub portion 61. A shaft coupling portion 63 for installing the shaft 41 may be formed at the center of the hub portion 61. The plurality of flange portions 62 may be formed at intervals of 120 degrees around the hub portion 61. The plurality of flange portions 62 may be formed to correspond to the diameter of the drum back 100. A plurality of fastening holes 64 may be formed at one end of each flange portion 62. The plurality of fastening holes 64 may be formed to correspond to the coupling holes 35 of the drum 30. In an embodiment of the disclosure, it is shown as an example that two fastening holes are formed in one flange portion, but the spirit of the present disclosure is not limited thereto. For example, the fastening holes may be formed in different ways depending on the size and shape of the drum and flange portion.

The shaft 41 may be arranged between the drum 30 and the motor 40. One end of the shaft 41 may be connected to the drum back 100, and the other end may extend to the outside of the tub back 200. When the motor 40 drives the shaft 41, the drum 30 connected to the shaft 41 may rotate about the shaft 41.

The bearing housing 51 may be installed in the tub back 200 to rotatably support the shaft 41. The bearing housing 51 may be made of aluminum alloy, and may be insert-injected into the tub back 200 of the second tub 20 when the tub 20 is injection molded. The bearing 52 may be installed between the bearing housing 51 and the shaft 41 to allow the shaft 41 to rotate smoothly.

The washing machine 1 may further include the drying duct 70 provided to heat air and supply the heated air to the interior of the tub 20.

The drying duct 70 may be provided at the upper portion of the tub 20, but a location thereof is not limited thereto.

The drying duct 70 may include a housing 71 forming an exterior thereof, a heater 73 provided inside the housing 71 to heat air, and a blowing fan 74.

The heater 73 and the blowing fan 74 of the drying duct 70 may be disposed inside the housing 71. One end of the drying duct 70 may be connected to the exhaust duct 80, which will be described later, and the other end may be connected to the connection portion 25 provided in front of the tub 20. The blowing fan 74 may be operable by a drive motor 74*a*.

The washing machine 1 may further include the exhaust duct 80 provided to supply air discharged from the tub 20 to the drying duct 70.

The exhaust duct 80 is provided to exhaust moist air that passes through the tub 20. The exhaust duct 80 may be provided at the rear side of the tub 20, but the location thereof is not limited thereto.

The exhaust duct 80 may include a case 81 forming an exterior thereof. The case 81 may include a first case 81*a* and a second case 81*b*. A rim of the first case 81*a* and the second case 81*b* may be provided with a fastening portion 81*c* such that the first case 81*a* and the second case 81*b* are joined by a fastener (not shown). A plurality of fastening portions 81*c* may be provided. The plurality of fastening portions 81*c* may be arranged to be spaced apart from each other.

The first case 81*a* and the second case 81*b* may be coupled to each other to form a passage portion 87 through which air flows therein.

In the present embodiment, the case is shown as an example in which the first case and the second case, which are separate, are coupled to each other, but the case is not limited thereto. For example, the case may be formed as a unitary unit.

One end of the exhaust duct 80 may be connected to the tub back 200 and the other end may be connected to the drying duct 70.

An exhaust port connection portion 82 corresponding to the exhaust port 220 of the tub back 200 may be formed in the exhaust duct 80. The exhaust port connection portion 82 may be formed in a shape corresponding to the exhaust port 220. A sealing member 86 may be disposed between the exhaust port connection portion 82 and the exhaust port 220. The exhaust port connection portion 82 may be provided in the case 81. The exhaust port connection portion 82 may be provided in the first case 81*a* to connect the exhaust duct 80 and the tub back 200.

Figure 4:
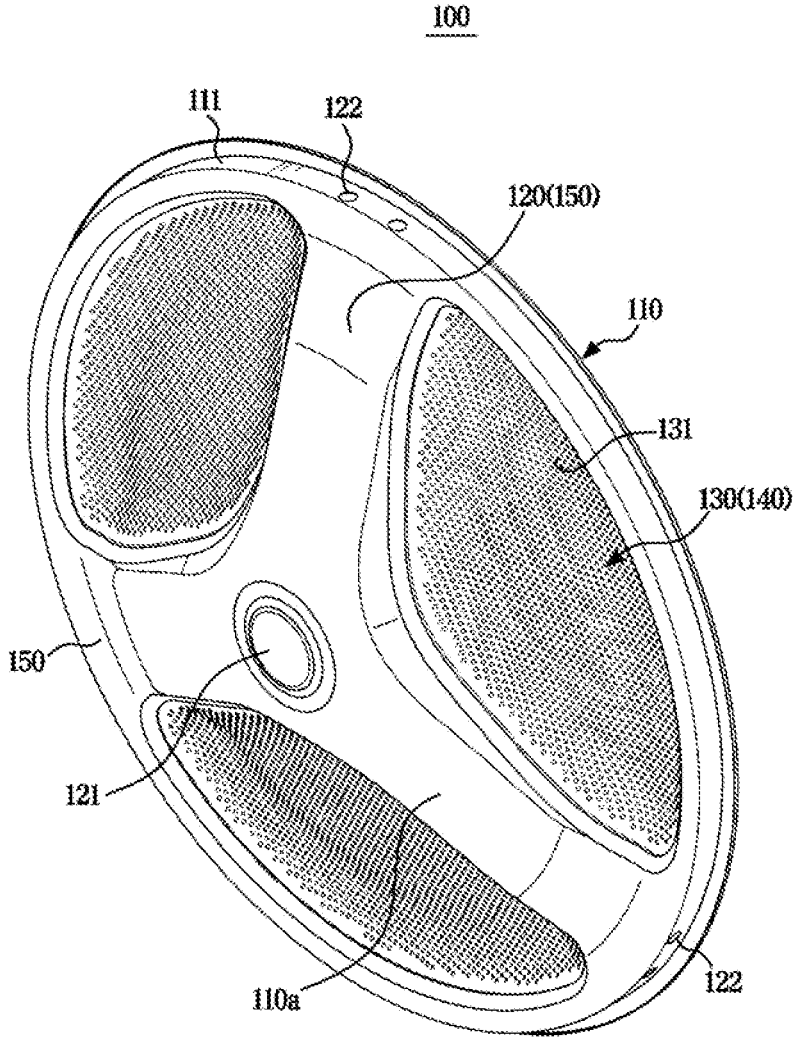
FIG. 4 is a perspective view showing a drum back according to an embodiment of the present disclosure.
Figure 5:
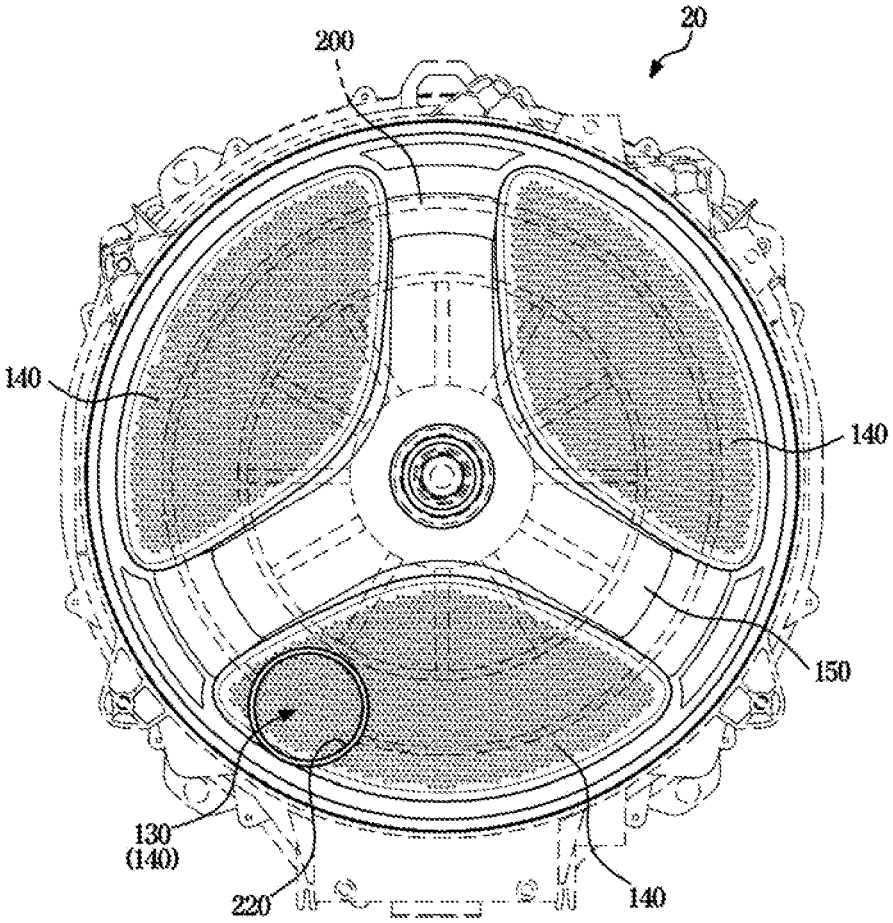
FIG. 5 is a front view showing the drum back and a tub back according to an embodiment of the present disclosure.

FIG. 4 is a perspective view illustrating the drum back according to an embodiment, and FIG. 5 is a front view illustrating the drum back and the tub back according to an embodiment.

As shown in FIGS. 4 and 5, the drum back 100 provided at the rear end of the drum 30 may be provided to block the rear end opening of the drum body 32. The drum back 100 may be provided to be inserted into the rear end opening of the drum body 32.

The drum back 100 may include a first region 140 in which the plurality of holes 131 are formed, and a second region 150 correspondingly provided on which the shaft flange 60 is seated.

The drum back 100 may include a drum back body 110 formed in a disc shape. The disc-shaped drum back body 110 may include a front surface 110*a*, and a rear surface 110*b* formed on the opposite side of the front surface 110*a*. The front surface 110*a* of the drum back body 110 may refer to a surface facing the inside of the drum 30, and the rear surface 110*b* of the drum back body 110 may refer to a surface facing the outside of the drum 30.

The drum back 100 may include a plurality of recess portions 120, each corresponding to the plurality of flange portions 62 and formed to be recessed from the rear to the front, and an opening 130 formed between adjacent recess portions 120. The opening 130 may refer to the first region 140. The plurality of recess portions 120 may refer to the second region 150.

The drum back body 110 may include the opening 130 in which the plurality of holes 131 are formed, and the recess portions 120 on which the shaft flange 60 is seated.

The recess portion 120 may be provided at the center of the drum back body 110 to correspond to the flange shaft 60, respectively. The recess portion 120 may be provided in a plurality to correspond to the plurality of flange portions 62 of the flange shaft 60. The recess portions 120 may be formed to protrude toward a front side of the drum back body 110.

A shaft support 121 may be formed at the center of the drum back body 110 to support the shaft 41. The shaft support 121 may be disposed at the center of the recess portions 120. The shaft support 121 may be located in the recess portion 120. The shaft support 121 may be located in the second region 150.

A rim 111 may be provided on the drum back body 110 of the drum back 100. The rim 111 may be formed by bending from an outer end of the drum back body 110 to correspond to an inner diameter of the drum 30. The rim 111 of the drum back 100 may be provided with a shaft flange fixing portion 122. The shaft flange fixing portion 122 may be formed to correspond to the coupling holes 35 of the drum body 32. The shaft flange fixing portion 122 may be formed to correspond to the fastening holes 64 of the shaft flange 60. The shaft flange fixing portions 122 may be formed to be spaced apart in the circumferential direction. The shaft flange fixing portion 122 may be formed to correspond to the fastening holes 64 of the shaft flange 60 and the coupling holes 35 of the drum body 32, and may be fixed to each other through a faster (not shown).

The openings 130 of the drum back 100 may include a portion except for the recess portions 120. The openings 130 may be formed between the plurality of recess portions 120 adjacent to each other. The plurality of holes 131 may be formed in the openings 130 of the drum back 100. The plurality of holes 131 may be formed in each opening 130 of the drum back 100.

The opening 130 of the drum back 100 may be formed in three sections. The openings 130 of the drum back 100 may be formed at intervals of 120 degrees. The openings 130 of the drum back 100, i.e., the first region 140, may be formed to be spaced apart in the circumferential direction by the second region 150. The first region 140 of the drum back 100 may be formed at a predetermined interval by the recess portions 120 formed in the disc-shaped drum back body 110.

The drum back 100 may be made of steel material. The drum back body 110 may be made of steel material. The recess portions 120 and the openings 130 of the drum back 100 may be formed integrally with a steel material. The first region 140 and the second region 150 of the drum back 100 may be formed integrally with a steel material.

The plurality of holes 131 may be formed in the respective opening 130 of the drum back 100 at regular intervals. The openings 130 of the drum back 100 may be formed at a position corresponding to the exhaust port 220 of the tub 20. The openings 130 of the drum back 100 may be placed in communication with the exhaust port 220 of the tub 20. The area of the openings 130 of the drum back 100 may be formed to be larger than the area of the exhaust port 220 of the tub 20. The area of the exhaust port 220 of the tub 20 may be smaller than the area of the openings 130 of the drum back 100.

Accordingly, during rotation of the drum 30, air may move to the exhaust port 220 of the tub 20 through the plurality of holes 131 formed in the openings 130 of the drum back 100, thereby improving drying efficiency.

The openings 130 of the drum back 100 may be positioned to correspond to the entire area of the exhaust port 220 of the tub 20, thereby improving fluid flow, i.e., a flow of air. Air discharged through the openings 130 of the drum back 100 may flow smoothly through the exhaust port 220 of the tub 20 without obstructing the flow.

Figure 6:
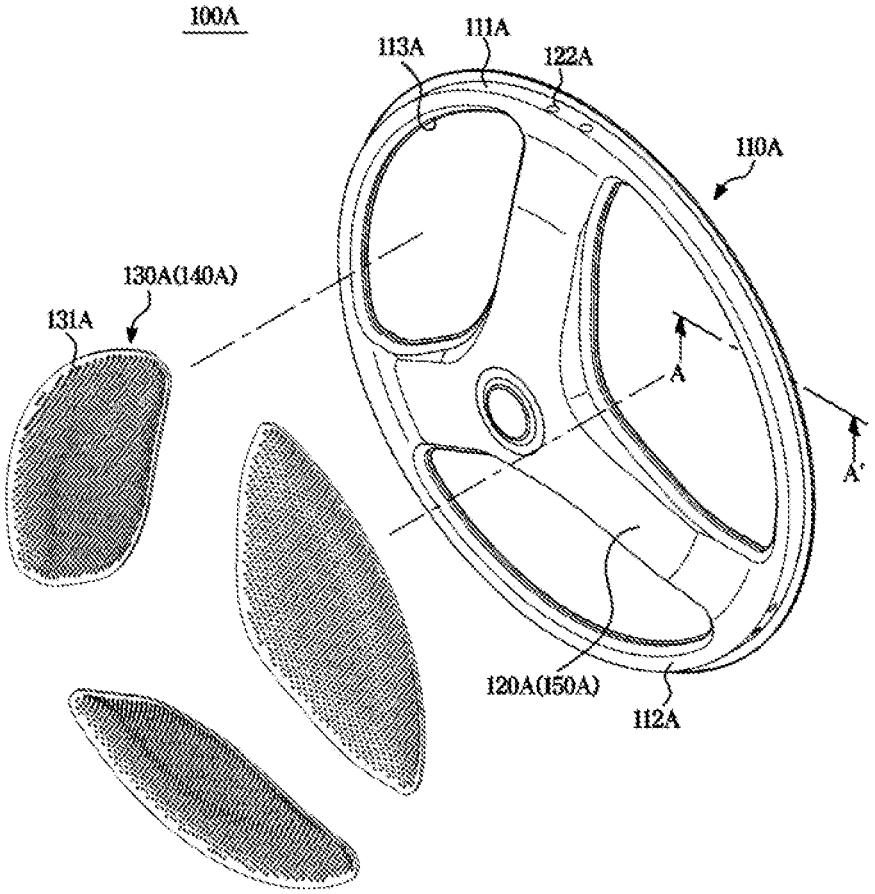
FIG. 6 is a perspective view showing a rear surface of the drum of the washing machine according to an embodiment of the present disclosure.
Figure 7:
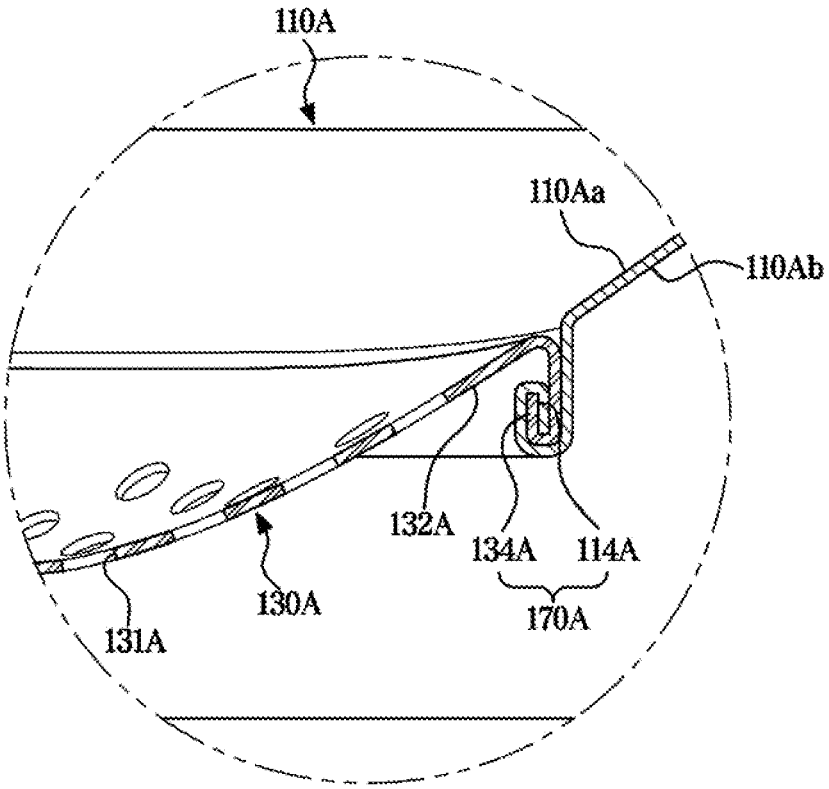
FIG. 7 is a cross-sectional view taken along line A-A' of FIG. 6, showing the rear surface of the drum formed by a manufacturing method according to an embodiment of the present disclosure.

FIG. 6 is a perspective view illustrating the rear surface of the drum of the washing machine according to an embodiment, and FIG. 7 is a cross-sectional view taken along line A-A' of FIG. 6, showing the rear surface of the drum formed by a manufacturing method according to an embodiment. Hereinafter, portion of the description that are redundant with the above description will be omitted.

As shown in FIGS. 6 and 7, a first region 140A of a drum back 100A may include a porous plate 130A in which a plurality of holes 131A are formed.

The drum back 100A may include a plurality of recess portions 120A, each corresponding to the plurality of flange portions 62 and formed to be recessed from the rear to the front, and an opening 113A formed between adjacent recess portions 120A. The opening 113A may refer to a first region 140A. The plurality of recess portions 120A may refer to a second region 150A.

The drum back 100A may include a drum back body 110A having an opening 113A at least partially open in a disk shape, and the porous plate 130A provided to be coupled to the opening 113A of the drum back body 110A.

The porous plate 130A may include a plate in which the plurality of holes 131A are formed. The porous plate 130A may be formed with the plurality of holes 131A spaced apart from each other at certain intervals. The porous plate 130A may form the first region 140A.

The porous plate 130A of the drum back 100A may be coupled to the opening 113A of the drum back body 110A.

The drum back body 110A of the drum back 100A may include a front surface 110Aa facing the inside of the drum 30 and a rear surface 110Ab formed on the opposite side of the front face 110Aa and facing the outside of the drum 30.

The drum back body 110A may include a disc-shaped plate portion 112A and a rim 111A formed by bending an outer edge of the plate portion 112A. The rim 111A may be formed by bending from an outer end of the drum back body 110A to correspond to the inner diameter of the drum 30. A shaft flange fixing portion 122A may be formed on the rim 111A of the drum back 100A.

The opening 113A of the drum back 100A may be formed by opening at least a portion of the drum back body 110A.

The recess portion 120A for installing the flange shaft 60 may be provided in the plate portion 112A of the drum back body 110A. The recess portion 120A may be formed to correspond to the flange shaft 60. The recess portion 120A may be formed in a corresponding shape so that the flange shaft 60 may be seated thereon. The recess portion 120A may be formed to protrude toward the front of the plate portion 112A.

The opening 113A may be provided in the plate portion 112A of the drum back body 110A so that the porous plate 130A may be coupled thereto. The opening 113A may be formed in a shape corresponding to the porous plate 130A. The opening 113A may be formed in three sections. The openings 113A may be formed at intervals of 120 degrees in the plate portion 112A of the drum back body 110A. The openings 113A may be formed to be spaced apart in the circumferential direction by the recess portions 120A. The opening 113A may be formed to be cut out of the plate portion 112A to allow the porous plate 130A to be installed.

The drum back body 110 of the drum back 100 may be made of steel material. The plate portion 112A of the drum back body 110A may be made of steel material. The porous plate 130A may be made of steel. The porous plate 130A may be coupled to the opening 113A of the drum back body 110A by a seaming method. Seaming is a type of sealing method and may be mainly used for joints that require air-tightness and water-tightness.

The porous plate 130A and the drum back body 110A may include a seaming portion 170A. The seaming portion 170A may include a first seaming portion 134A formed on the rim of the porous plate 130A, and a second seaming portion 114A formed on a porous plate installation portion of the plate portion 112A.

The seaming portion 170A may be formed by bending the ends of the porous plate 130A and the opening 113A of the plate portion 112A by a predetermined length to bring the ends into contact with each other and joining the ends through a seaming process.

The seaming portion 170A may be located on the rear surface 110Ab side of the drum back 100A. The seaming portion 170A may be located outside the drum 30.

Figure 8:
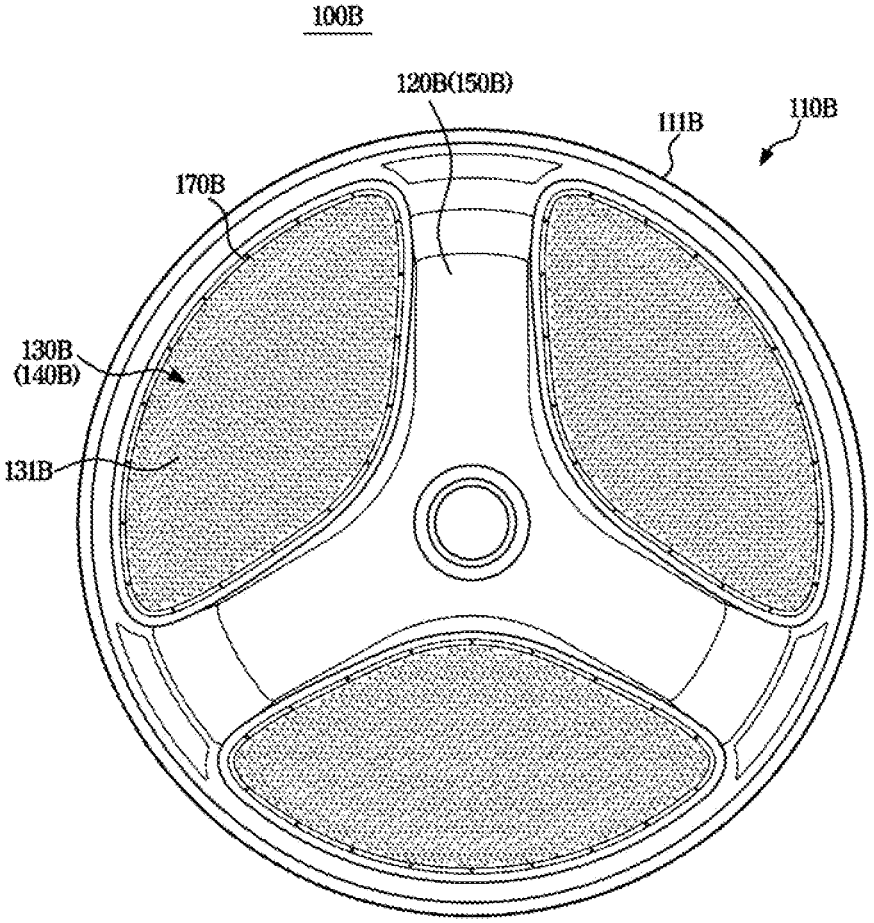
FIG. 8 is a perspective view showing the rear surface of the drum of the washing machine according to an embodiment of the present disclosure.
Figure 9:
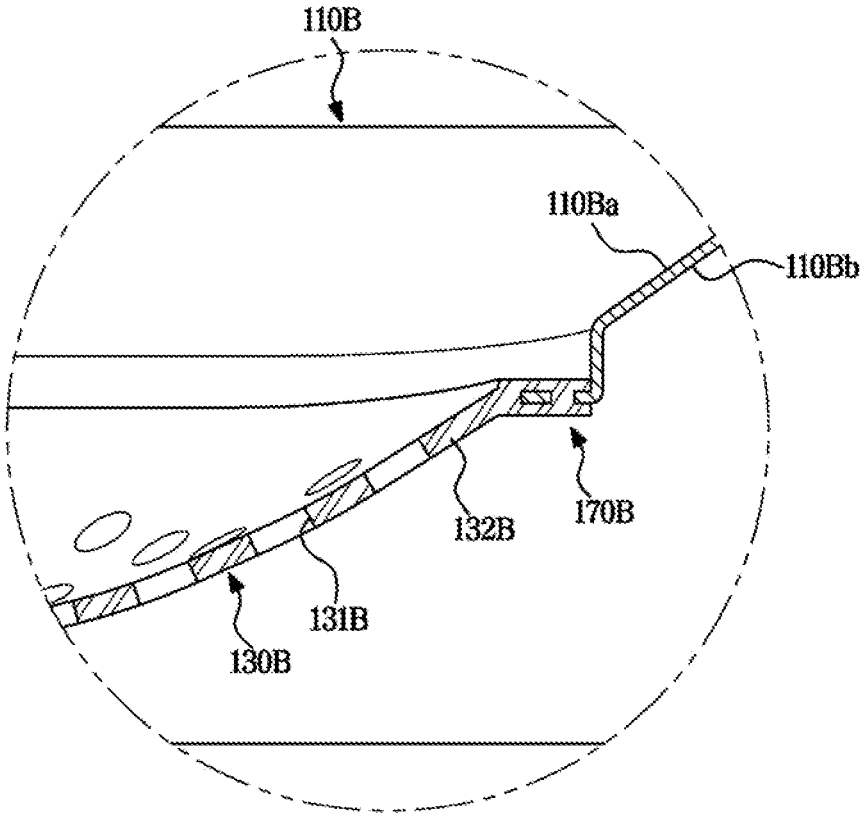
FIG. 9 is a cross-sectional view taken along line B-B' of FIG. 8, showing the rear surface of the drum formed by the manufacturing method according to an embodiment of the present disclosure.

FIG. 8 is a perspective view illustrating the rear surface of the drum of the washing machine according to an embodiment, and FIG. 9 is a cross-sectional view of portion B-B' of FIG. 8, showing the rear surface of the drum formed by a manufacturing method according to an embodiment.

As shown in FIGS. 8 and 9, a first region 140B of the drum back 100B may include a porous plate 130B in which a plurality of holes 131B are formed.

The drum back 100B may include a plurality of recess portions 120B, each corresponding to the plurality of flange portions 62 and formed to be recessed from the rear to the front, and an opening 113B formed between adjacent recess portions 120B. The opening 113B may correspond to the first region 140B. The plurality of recess portions 120B may correspond to a second region 150B.

The drum back 100B may include a drum back body 110B formed in a disc-shape, and the porous plate 130B coupled to the drum back body 110B.

The porous plate 130B may include a plate in which the plurality of holes 131B are formed. The porous plate 130B may be formed with the plurality of holes 131B spaced apart from each other at certain intervals. The porous plate 130B may form the first region 140B.

The porous plate 130B may be formed in a shape corresponding to the opening 113B so that the porous plate 130B may be coupled to the opening 113B.

The drum back body 110B of the drum back 100B may include a front surface 110Ba facing the inside of the drum 30 and a rear surface 110Bb formed on the opposite side of the front face 110Ba and facing the outside of the drum 30. The drum back body 110B may include a disk-shaped plate portion 112B and a rim 111B formed by bending an outer edge of the plate portion 112B. The rim 111B may be formed by bending from an outer end of the drum back body 110B to correspond to the inner diameter of the drum 30.

The recess portion 120B for installing the flange shaft 60 may be provided in the plate portion 112B of the drum back body 110B. The recess portion 120B may be formed to correspond to the flange shaft 60. The recess portion 120B may be formed in a corresponding shape so that the flange portion 62 of the flange shaft 60 may be seated thereon. The plurality of recess portions 120B may be provided to correspond to the flange portions 62.

The drum back body 110B of the drum back 100B may be formed of steel material. The plate portion 112B of the drum back body 110B may be formed of steel material.

The porous plate 130B may be formed of a resin material. The porous plate 130B may be insert-molded into the opening 113B of the drum back body 110B.

The opening 113B may be formed in the plate portion 112B of the drum back body 110B to allow the porous plate 130B to be coupled thereto. The opening 113B may be formed in three sections. The openings 113B may be formed at intervals of 120 degrees in the drum back body 110B. The three openings 113B may be formed spaced apart in the circumferential direction by the plurality of recess portions 120B.

The porous plate 130B and the drum back body 110B may include a coupling portion 170B. The coupling portion 170B may be provided to connect the porous plate 130B and the drum back body 110B by insert injection.

Figure 10:
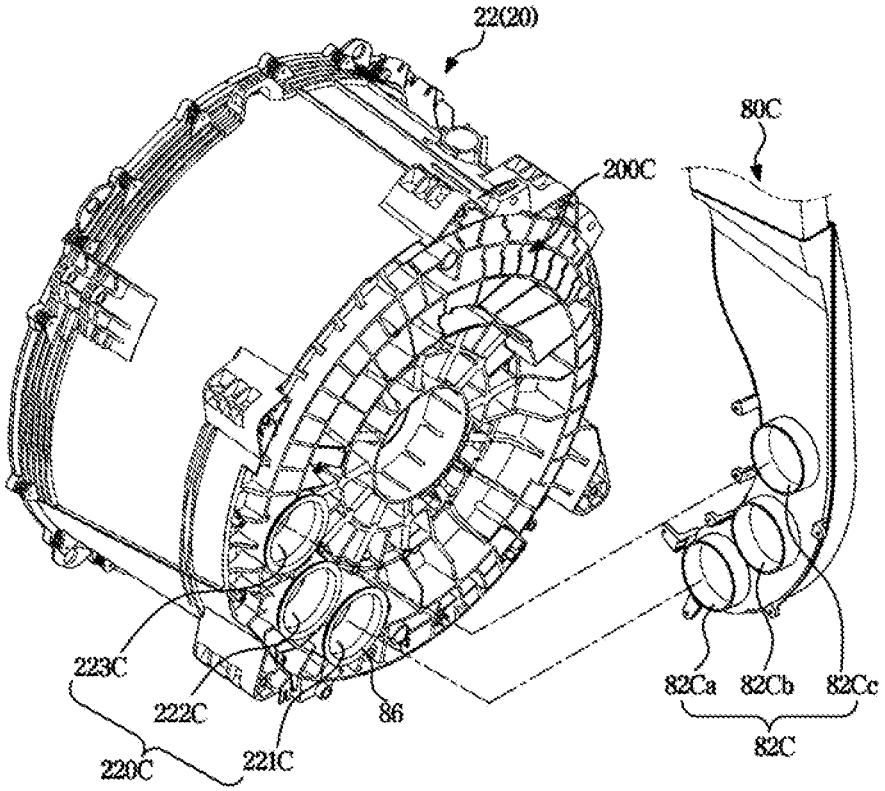
FIG. 10 is a view showing a state before the drying duct is connected to the rear surface of the tub according to an embodiment of the present disclosure.
Figure 11:
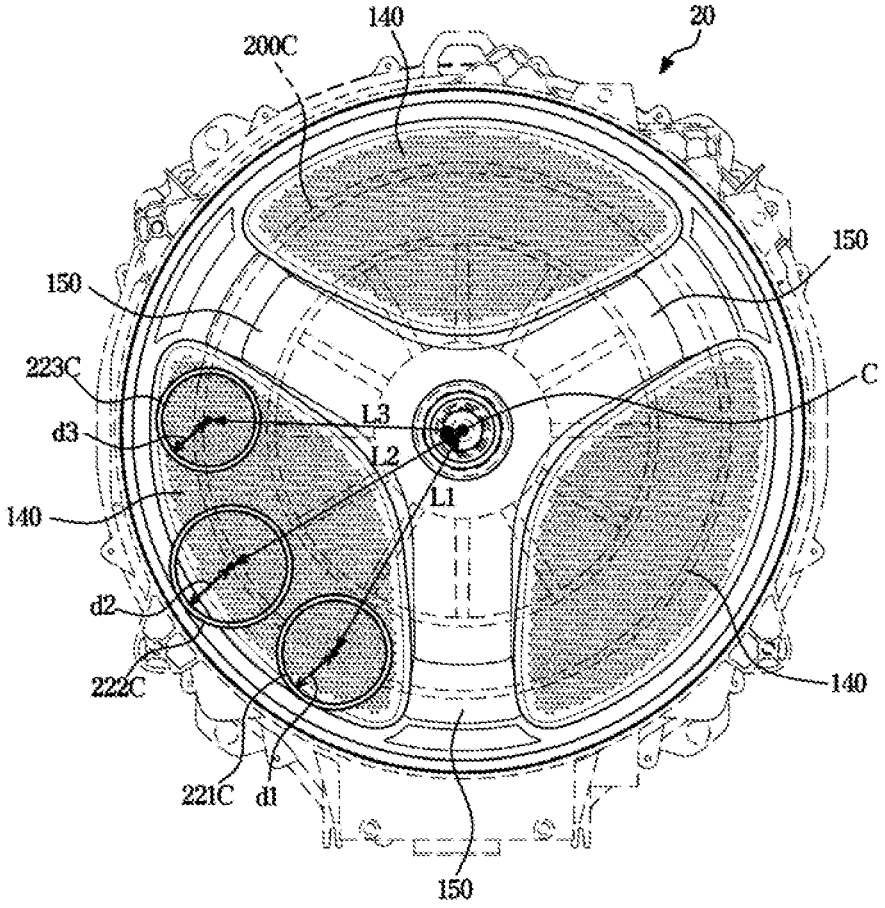
FIG. 11 is a view showing the rear surface of the tub of the washing machine according to an embodiment of the present disclosure.

FIG. 10 is a view illustrating a state before the drying duct is connected to the rear surface of the tub according to an embodiment, and FIG. 11 is a view illustrating the rear surface of the tub of the washing machine according to an embodiment. Hereinafter, portion of the description that are redundant with the above description will be omitted.

As shown in FIGS. 10 and 11, the tub 20 may include a tub back 200C forming a rear surface thereof.

The tub back 200C may have an exhaust portion 220C formed at one lower side to which the exhaust duct 80 is connected. The exhaust portion 220C may be provided to connect the exhaust duct 80 and the tub 20. The exhaust portion 220C may include at least one or more exhaust port 221C, 222C, and 223C formed in the tub back 200C.

The exhaust portion 220C may be formed with at least one to prevent problems that may occur when the flange shaft 60 coupled to the rotating drum 30 blocks the exhaust portion 220C formed in the tub back 200C.

The exhaust portion 220C may be formed with at least one or more to prevent problems that may occur when the flange portion 62 of the flange shaft 60 coupled to the rear surface of the rotating drum 30 blocks the exhaust portion 220C of the tub back 200C.

During rotation of the drum 30, the flange shaft 60 fixed to the drum back 100 may rotate. At a stop of the drum 30, the flange portion 62 of the flange shaft 60 may block the exhaust portion 220C located on the lower side of the tub 20 depending on a stopping position of the drum 30, thereby causing the obstruction to air flow.

In addition, foreign substances such as lint may accumulate around the exhaust portion 220C located at the lower portion of the tub 20, which may block the flow path between the exhaust portion 220C and the exhaust duct 80, thereby causing the obstruction to air flow.

To prevent such a situation, the exhaust portion 220C of the tub back 200C may include the plurality of exhaust ports 221C, 222C, and 223C. The exhaust ports 221C, 222C, and 223C may include a first exhaust port 221C, a second exhaust port 222C, and a third exhaust port 223C.

The first exhaust port 221C, the second exhaust port 222C, and the third exhaust port 223C may be positioned at different distances from the center C of the tub back 200C. The first exhaust port 221C, the second exhaust port 222C, and the third exhaust port 223C may each be positioned at different distances from the center of the rear surface of the tub 20. The first exhaust port 221C, the second exhaust port 222C, and the third exhaust port 223C may be positioned at different positions from the center C of the tub back 200C. The first exhaust port 221C, the second exhaust port 222C, and the third exhaust port 223C may be connected to the exhaust duct 80 at a plurality of different positions regardless of the position of the flange shaft 60 coupled to the drum 30, so that there is no obstruction to air flow to improve drying efficiency.

Specifically, when one of the plurality of flange portions 62 is in a position overlapping with one of the plurality of exhaust ports 221C, 222C, and 223C, at least a different one of the plurality of exhaust ports 221C, 222C, and 223C may be in a position not overlapping with any one of the plurality of flange portions 62.

The first exhaust port 221C may be positioned on one lower side from the center C of the tub back 200C. The first exhaust port 221C may be formed at a first interval L1 from the center C of the tub back 200C. The second exhaust port 222C may be formed at a second interval L2 from the center C of the tub back 200C. The third exhaust port 223C may be formed at a third interval L3 from the center C of the tub back 200C. In this case, the first interval L1, the second interval L2, and the third interval L3 may have different lengths.

The plurality of exhaust ports 221C, 222C, and 223C may have different widths. At least one of the plurality of exhaust ports 221C, 222C, and 223C may have a width different from that of another exhaust port.

A first diameter d1 of the first exhaust port 221C, a second diameter d2 of the second exhaust port 222C, and a third diameter d3 of the third exhaust port 223C may be formed differently. As such, exhaust ports having different diameters and sizes and spaced at different intervals, may enable equivalent drying performance in different environments.

The exhaust duct 80 may be provided with an exhaust connection portion 82C corresponding to the exhaust portion 220C of the tub back 200C. The exhaust portion connection portion 82C may be formed to correspond to the exhaust portion 220C. The corresponding sealing member 86 may be provided between the exhaust portion connection portion 82C and the exhaust portion 220C.

The exhaust connection portion 82C may include a first connector 82Ca, a second connector 82Cb, and a third connector 82Cc. The first connector 82Ca may be connected to the first exhaust port 221C. The second connector 82Cb may be connected to the second exhaust port 222C. The third connector 82Cc may be connected to the third exhaust port 223C. The first connector 82Ca, the second connector 82Cb, and the third connector 82Cc may be formed at a position corresponding to the first exhaust port 221C, the second exhaust port 222C, and the third exhaust port 223C, respectively. In an embodiment of the present disclosure, the exhaust port of the tub back is illustrated as including three exhaust ports, but the spirit of the present disclosure is not limited thereto. For example, the number of exhaust ports formed in the tub back may be varied in various ways. In addition, the number of exhaust port connectors of the exhaust duct connected to the exhaust port may be varied depending on the exhaust port.

Furthermore, in an embodiment of the present disclosure, a exhaust port and a exhaust port connector are each shown as a circular shape, but the spirit of the present disclosure is not limited thereto. For example, the connection hole and the connector may each include an oval shape, a square shape, or the like formed at corresponding positions.

While the present disclosure has been particularly described with reference to exemplary embodiments, it should be understood by those of skilled in the art that various changes in form and details may be made without departing from the spirit and scope of the present disclosure.

The invention claimed is:

1. A washing machine with a drying function, comprising:
a tub to store washing water and including a plurality of exhaust ports, at least one exhaust port of the plurality of exhaust ports:
is a distance from a center of a rear surface of the tub that is different from a distance from the center of the rear surface of the tub in comparison to another exhaust port of the plurality of exhaust ports, and/or
has a width that is different from a width of another exhaust port of the plurality of exhaust ports, and/or
has a diameter that is different from a diameter of another exhaust port of the plurality of exhaust ports;
a drum inside the tub and including:
a cylindrical body having a front end opening and a rear end opening, and
a drum back coupled to the cylindrical body so as to be over the rear end opening of the cylindrical body and including:
a plurality of recess portions recessed from a rear of the drum back toward a front of the drum,
a plurality of openings formed between each adjacent recess portions of the plurality of recess portions, and
a plurality of porous plates respectively corresponding, and respectively coupled, to the plurality of openings;
a motor to provide a rotational force to the drum;
a flange shaft between the drum and the motor to transmit the rotational force of the motor to the drum and including:
a hub at a center of the drum back, and
a plurality of flange portions extending radially from the hub and respectively corresponding to the plurality of recess portions;
a drying duct configured to supply heated air into the tub; and
an exhaust duct configured to return the heated air from the tub through the plurality of porous plates and the plurality of exhaust ports to the drying duct.

2. The washing machine of claim 1, wherein each recess portion of the plurality of recess portions is formed of a metal material, and each porous plate of the plurality of porous plates is formed of a resin material.

3. The washing machine of claim 2, wherein each porous plate of the plurality of porous plates is coupled to the corresponding opening of the plurality of openings by an insert injection method.

4. The washing machine of claim 1, wherein each porous plate of the plurality of porous plates is coupled to the corresponding opening of the plurality of openings by a seaming method.

5. The washing machine of claim 1, wherein
the exhaust duct includes a plurality of exhaust connection portions respectively corresponding to, and respectively connecting, the plurality of exhaust ports to the exhaust duct.

6. The washing machine of claim 5, wherein with the drum is-rotated by the rotational force to a position such that one flange portion of the plurality of flange portions overlaps one or more exhaust ports of the plurality of exhaust ports, at least one different exhaust port of the plurality of exhaust ports is not overlapped by any flange portion of the plurality of flange portions.

7. The washing machine of claim 1, wherein the drum back includes a rim corresponding to an inner diameter of the cylindrical body.

8. The washing machine of claim 7, wherein the rim includes a plurality of flange shaft fixing portions corresponding to the plurality of flange portions and configured such that the drum back, the cylindrical body, and the plurality of flange portions are fastened together through the rim.

9. A washing machine with a drying function comprising:
a tub including a tub back having a plurality of exhaust ports through the tub back;
a cylindrical drum, inside the tub, having a front end opening and a rear end opening and including:
a drum back spaced apart from the tub back, coupled to the cylindrical drum so as to be over the rear end opening, and including:
a plurality of first regions that each include a plurality of holes through the drum back, and
a plurality of second regions extending radially and separating adjacent first regions of the plurality of first regions in a circumferential direction of the drum back;
a drying duct to supply heated air into the tub;
a motor to provide a rotational force to the cylindrical drum, wherein
the plurality of exhaust ports are configured such that, when the cylindrical drum is rotated by the rotational force to a position at which a second region of the plurality of second regions overlaps an exhaust port of the plurality of exhaust ports, another exhaust port of the plurality of exhaust ports is overlapped by at least one first region of the plurality of first regions and is not obstructed by any second region; and
an exhaust duct connected to the plurality of exhaust ports to return the heated air from the tub, through the at least one first region of the plurality of first regions and the another exhaust port.

10. The washing machine of claim 9, wherein each exhaust port of the plurality of exhaust ports is a distance from a center of a rear surface of the tub, the distance of each exhaust port of the plurality of exhaust ports from the center is different from the distance of each other exhaust port of the plurality of exhaust ports from the center.

11. The washing machine of claim 9, wherein a width of at least one exhaust port of the plurality of exhaust ports is different from a width of another exhaust port of the plurality of exhaust ports.

12. The washing machine of claim 9, wherein a diameter of at least one exhaust port of the plurality of exhaust ports is different from a diameter of another exhaust port of the plurality of exhaust ports.

13. The washing machine of claim 9, wherein the drum back includes a rim corresponding to an inner diameter of the cylindrical drum.

14. The washing machine of claim 13, wherein the rim includes a plurality of flange shaft fixing portions corresponding to a plurality of flange portions and configured such that the drum back, the cylindrical drum, and the plurality of flange portions are fastened together through the rim.

* * * * *